US010802424B2

(12) United States Patent
Miyoshi et al.

(10) Patent No.: US 10,802,424 B2
(45) Date of Patent: Oct. 13, 2020

(54) FIXING DEVICE AND IMAGE FORMING APPARATUS

(71) Applicant: FUJI XEROX CO., LTD., Tokyo (JP)

(72) Inventors: Noriyuki Miyoshi, Kanagawa (JP); Yuhei Tomita, Kanagawa (JP); Kazuma Teranishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/544,139

(22) Filed: Aug. 19, 2019

(65) Prior Publication Data

US 2020/0249596 A1 Aug. 6, 2020

(30) Foreign Application Priority Data

Jan. 31, 2019 (JP) ..... 2019-015706

(51) Int. Cl.
*G03G 15/20* (2006.01)
*G03G 15/16* (2006.01)

(52) U.S. Cl.
CPC ..... *G03G 15/1675* (2013.01); *G03G 15/2064* (2013.01); *G03G 2215/2019* (2013.01); *G03G 2215/2025* (2013.01)

(58) Field of Classification Search
CPC ..... G03G 15/1675; G03G 15/2032; G03G 15/2064
USPC ..... 399/67, 122, 320, 328–331; 219/216, 219/619
See application file for complete search history.

(56) References Cited

U.S. PATENT DOCUMENTS 7,787,788 B2 * 8/2010 Nakamura ..... G03G 15/2039 399/67
8,219,016 B2 * 7/2012 Hasegawa ..... G03G 15/2064 399/122

FOREIGN PATENT DOCUMENTS

JP 2001-337553 A 12/2001

* cited by examiner

*Primary Examiner* — Hoan H Tran
(74) *Attorney, Agent, or Firm* — Sughrue Mion, PLLC

(57) ABSTRACT

A fixing device includes a heating unit, a pressure unit, a moving unit, and a controller. The heating unit is configured to heat a toner on a recording medium. The pressure unit is configured to transport the recording medium while sandwiching the recording medium in a nip that the pressure unit and the heating unit form. The moving unit is configured to change a nip state of the pressure unit with respect to the heating unit by moving the heating unit or the pressure unit. The controller is configured to, when plural recording media are transported continuously, control the moving unit so that the moving unit moves the heating unit or the pressure unit in a separation direction so as to reduce a nip width at a recording medium interval between the recording media.

11 Claims, 11 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2019-015706 filed Jan. 31, 2019.

BACKGROUND

1. Technical Field

The present disclosure relates to a fixing device and an image forming apparatus.

2. Related Art

There has been a fixing device of an electrophotographic apparatus which includes at least a heating roller, a pressure roller, and a heater lamp. The fixing device further includes a driving unit that presses the pressure roller against the heating roller by a cam and separates the pressure roller from the heating roller by the cam, and a changing unit that changes a load applied to the pressure roller by changing a stop position of the cam (JP-A-2001-337553).

SUMMARY

Aspects of non-limiting embodiments of the present disclosure relate to prevention of an image defect caused by a fluctuation in a nip pressure in a direction intersecting a recording medium transport direction due to a change in a profile of a pressure unit, as compared with a case where a nip state is not changed when recording media are continuously transported.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including: a heating unit configured to heat a toner on a recording medium; a pressure unit configured to transport the recording medium while sandwiching the recording medium in a nip that the pressure unit and the heating unit form: a moving unit configured to change a nip state of the pressure unit with respect to the heating unit by moving the heating unit or the pressure unit; and a controller configured to, when plural recording media are transported continuously, control the moving unit so that the moving unit moves the heating unit or the pressure unit in a separation direction so as to reduce a nip width at a recording medium interval between the recording media.

BRIEF DESCRIPTION OF THE DRAWINGS

Exemplary embodiment(s) of the present disclosure will be described in detail based on the following figures, wherein.

DETAILED DESCRIPTION

Figure 1:
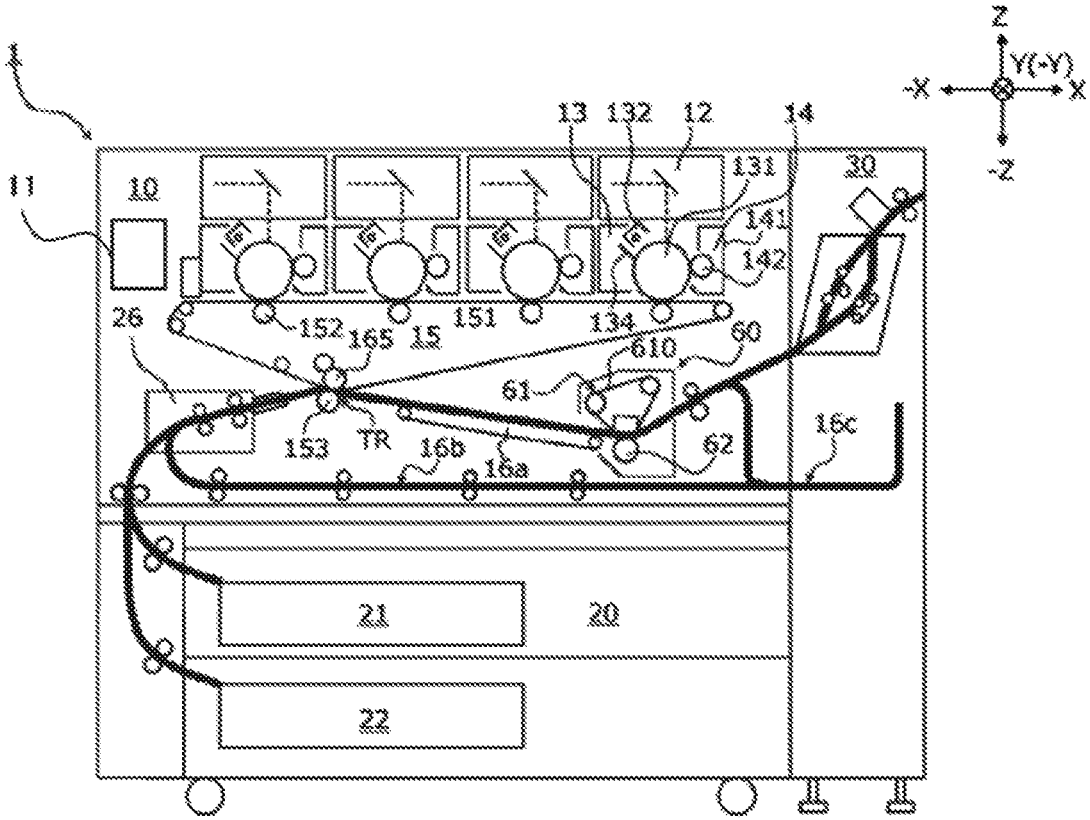
FIG. 1 is a schematic sectional view showing an example of the schematic configuration of an image forming apparatus.

The present disclosure will be described in more detail by way of the following exemplary embodiments and specific examples with reference to the accompanying drawings. However, the present disclosure is not limited to these exemplary embodiments and specific examples.

In the following description using the drawings, it should be noted that the drawings are schematic and ratios of dimensions and the like are different from actual ones. Illustration of members other than those necessary for the description is omitted as appropriate for the sake of easy understanding.

In order to facilitate understanding of the following description, a front-rear direction is an X-axis direction, a left-right direction is a Y-axis direction, and an upper-lower direction is a Z-axis direction in the drawings.

(1) Entire Configuration and Operation of Image Forming Apparatus (1.1) Entire Configuration of Image Forming Apparatus FIG. 1 is a schematic sectional view showing an example of a schematic configuration of an image forming apparatus 1 according to an exemplary embodiment.

The image forming apparatus 1 includes an image forming unit 10, a sheet feeding device 20 that is attached to a lower portion of the image forming unit 10, a sheet discharge unit 30 that is provided on one end of the image forming unit 10 and to which a printed sheet is discharged, and an image processing unit (not shown) that generates image information from printing information transmitted from an upper-order device.

The image forming unit 10 includes a system control device 11, exposure devices 12, photoconductor units 13, and developing devices 14, a transfer device 15, sheet transport devices 16*a*, 16*b*, and 16*c*, and a fixing device 60. The image forming unit 10 forms image information received from the image processing unit as a toner image on a sheet P fed from the sheet feeding device 20.

The sheet feeding device 20 including sheet trays 21, 22 is provided at a bottom portion of the image forming unit 10. The sheet feeding device 20 feeds sheets to the image forming unit 10. That is, plural sheet loading units that accommodate different types (for example, a material, a thickness, a sheet size, and a sheet texture) of the sheets P are provided, and the sheets P fed from any one of the plural sheet loading units are supplied to the image forming unit 10.

The sheet discharge unit 30 discharges the sheet P onto which an image is output by the image forming unit 10. For this purpose, the paper discharge unit 30 includes a discharged sheet accommodating unit (not shown) to which the sheet P after image output is discharged. The sheet transport device 16*c* is provided that inverts the sheet P and feeds the sheet P to the sheet transport device 16*b* when images are output on both sides of the sheet P.

The paper discharge unit 30 may have a function of performing post-processing such as cutting or stapling (needle binding) on a sheet bundle output from the image forming unit 10.

An operation information unit (not shown) is used for inputting various settings and instructions and displaying information. That is, the operation information unit 50 corresponds to a so-called user interface and is specifically implemented by a combination of a liquid-crystal display panel, various operation buttons, a touch panel and the like.

(1.2) Configuration and Operation of Image Forming Unit

In the image forming apparatus 1 having such a configuration, the sheet P, which is fed out from the sheet loading unit specified for each sheet by a printing job is fed to the image forming unit 10 from the sheet feeding device 20 according to a timing of image formation.

The photoconductor units 13 are provided in parallel with each other below the exposure devices 12. The photoconductor units 13 each includes a photoconductor drum 131 serving as an image carrier that rotationally perform driving. A charger 132, the exposure device 12, the developing device 14, a primary transfer roller 152, and a cleaning blade 134 are arranged along a rotation direction of each of the photoconductor drums 131.

The developing device 14 includes a developing housing 141 in which a developer is accommodated. A developing roller 142 that faces the photoconductor drum 131 is disposed in the developing housing 141. A layer regulating member (not shown) that regulates a layer thickness of the developer is disposed close to the developing roller 142.

The developing devices 14 are substantially the same except for the developers accommodated in the developing housings 141, and respectively form toner images of yellow (Y), magenta (M), cyan (C), and black (K). Each developing device 14 forms a toner band TB that is a belt-shaped toner image in a non-image region located between adjacent toner images on the photoconductor drum 131. Each developing device 14 functions as a belt-shaped toner image forming unit.

A surface of the rotatable photoconductor drum 131 is charged by the charger 132 and is formed with an electrostatic latent image by latent image forming light emitted from the exposure device 12. The electrostatic latent image formed on the photoconductor drum 131 is developed as a toner image by the developing roller 142.

The transfer device 15 includes an intermediate transfer belt 151 on which toner images of respective colors formed on the respective photoconductor drums 131 of the respective photoconductor units 13 are multiply transferred, the primary transfer rollers 152 that sequentially transfer (primarily transfer) the toner images of the respective colors formed on the respective photoconductor units 13 onto the intermediate transfer belt 151, and a secondary transfer roller 153 that collectively transfers (secondarily transfers) the toner images of the respective colors transferred onto and superimposed on the intermediate transfer belt 151 onto the sheet P that serves as a recording medium.

At a primary transfer unit where the intermediate transfer belt 151 comes into contact with the respective photoconductor drums 131, the toner images of the respective colors formed on the respective photoconductor drums 131 of the respective photoconductor units 13 are sequentially electrostatically transferred (primarily transferred) onto the intermediate transfer belt 151 by the primary transfer rollers 152 to which a predetermined primary transfer voltage is applied from a power supply device controlled by the system control device 11, and a superimposed toner image in which the toner images of the respective colors are superimposed is formed on the intermediate transfer belt 151.

As the intermediate transfer belt 151 moves, the superimposed toner image on the intermediate transfer belt 151 is transported to a secondary transfer unit TR in which the secondary transfer roller 153 is disposed in pressure contact with a backup roller 165 via the intermediate transfer belt 151.

When the superimposed toner image is transported to the secondary transfer unit TR, the sheet P is fed from the sheet feeding device 20 to the secondary transfer unit TR according to a timing of the transport. A preset secondary transfer voltage is applied from the power supply device controlled by the system control device 11 to the backup roller 165 facing the secondary transfer roller 153 via the intermediate transfer belt 151, and the superimposed toner image on the intermediate transfer belt 151 is collectively transferred onto the sheet P.

The toner remaining on the surface of the photoconductor drum 131 is removed by the cleaning blade 134 and is recovered in a waste toner accommodating unit (not shown). The surface of the photoconductor drum 131 is recharged by the charger 132.

The fixing device 60 includes a fixing belt module 61 including an endless fixing belt 610 that is an example of a heating unit which rotates in one direction, and a pressure roller 62 that is in contact with a peripheral surface of the fixing belt 610 and that is an example of a pressure unit which rotates in one direction. A nip portion N (fixing region) is formed by a pressure-contact region between the fixing belt 610 and the pressure roller 62.

The sheet P onto which the toner image is transferred by the transfer device 15 is transported to the fixing device 60 via the sheet transport device 16*a* in a state where the toner image is not fixed. The toner image is fixed to the sheet P transported to the fixing device 60 by the action of heating and pressure bonding by a pair of the fixing belt 610 and the pressure roller 62.

The sheet P after fixing is sent to the sheet discharge unit 30. When the images are output on both sides of the sheet P, the sheet P are inverted by the sheet transport device 16*c*, and the sheet P is fed again to the secondary transfer unit TR in the image forming unit 10 via the sheet transport device 16*b*. After transfer of the toner image and fixing of the transferred toner image, the sheet P is fed to the sheet discharge unit 30. The sheet P fed to the sheet discharge unit 30 is subjected to post-processing such as cutting or stapling (needle binding) as necessary.

(2) Configuration of Fixing Device

Figure 2:
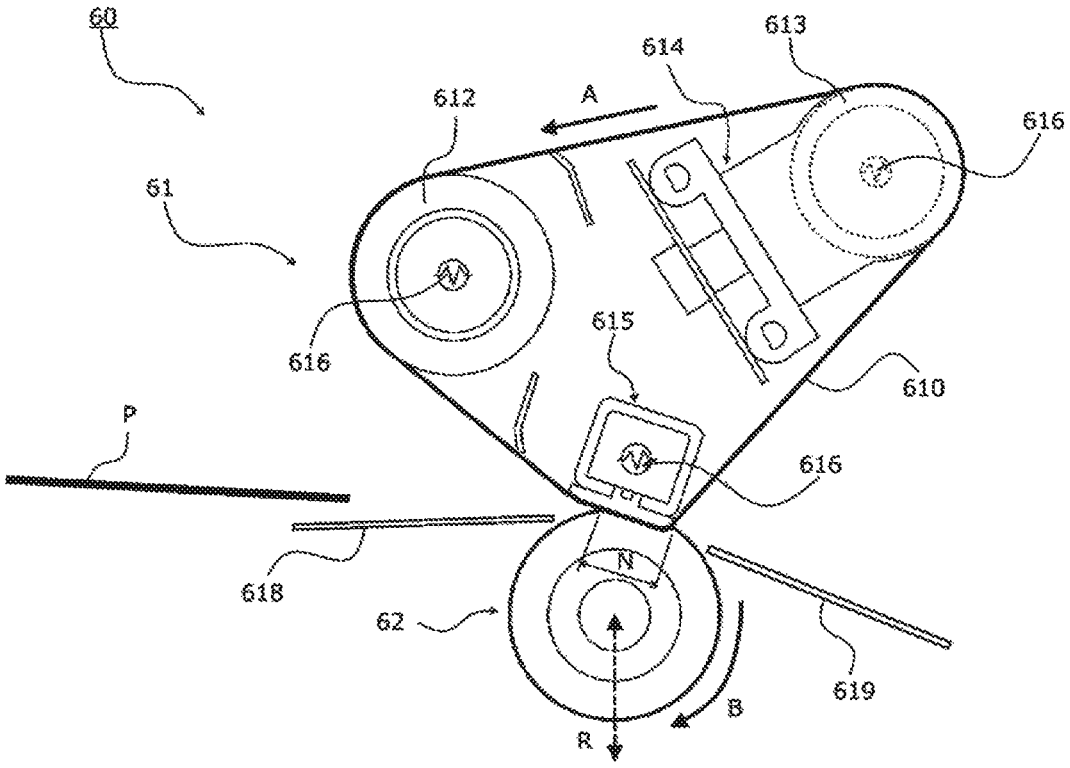
FIG. 2 is a schematic sectional view of a fixing device.
Figure 3A:
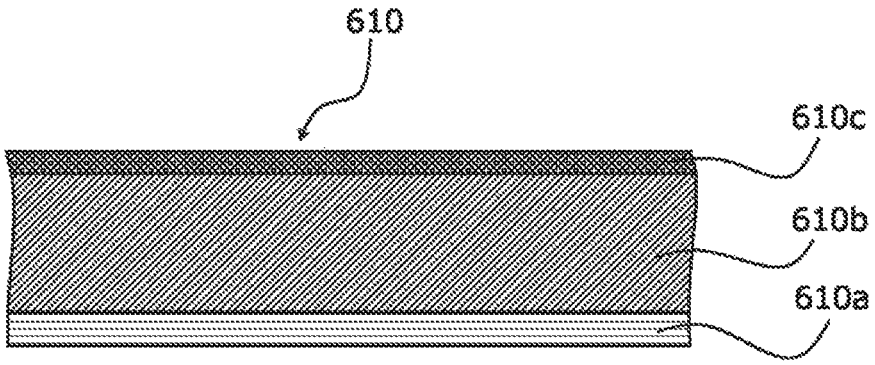
FIG. 3A is a schematic sectional view showing a layer configuration of a fixing belt.
Figure 3B:
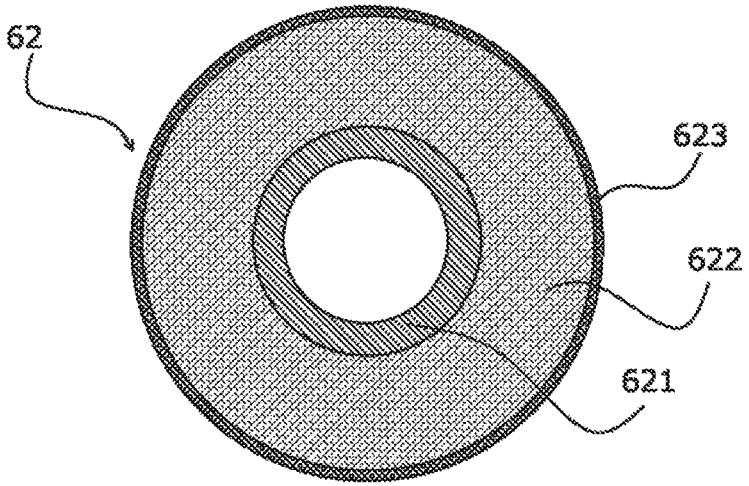
FIG. 3B is a schematic sectional view showing a layer configuration of a pressure roller.
Figure 4:
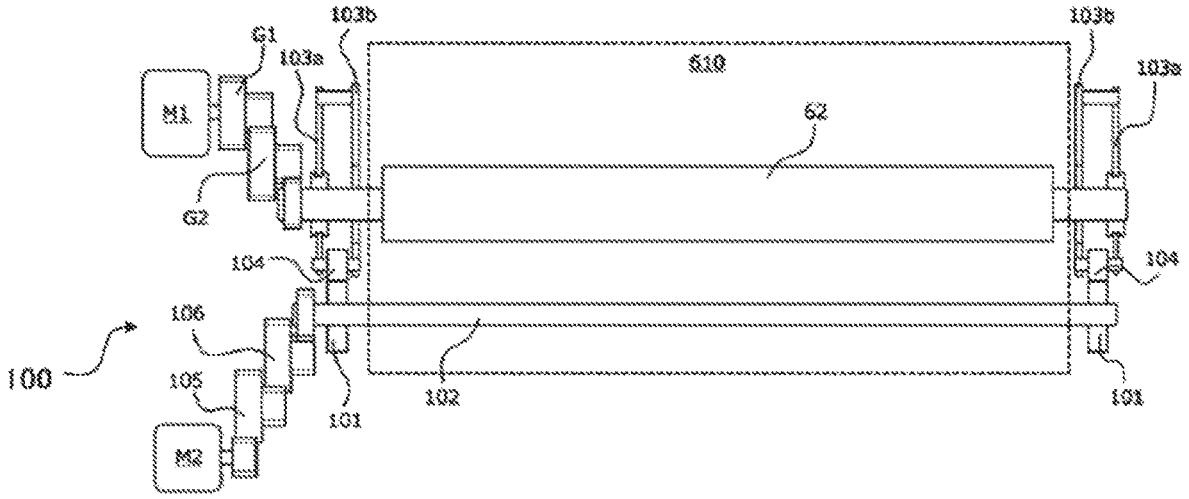
FIG. 4 is a schematic plan view showing a driving configuration of the fixing device.

FIG. 2 is a schematic sectional view of the fixing device 60 of the image forming apparatus 1 according to the exemplary embodiment. FIG. 3A is a schematic sectional view showing a layer configuration of the fixing belt 610. FIG. 3B is a schematic sectional view showing a layer configuration of the pressure roller 62. FIG. 4 is a schematic plan view showing a driving configuration of the fixing device 60.

The fixing device 60 includes the fixing belt module 61 including the fixing belt 610 that is the example of the heating unit, and the pressure roller 62 that is the example of the pressure unit and that is pressed against the fixing belt module 61.

In the fixing device 60, the pressure roller 62 forms the nip portion N by performing pressure contact with an outer peripheral surface of the fixing belt 610 when fixing is performed, and is retractable with respect to the fixing belt module 61 so as to be separated from the fixing belt 610 when the fixing is not performed.

The pressure roller 62 is rotationally driven by a driving motor M1 via a transmission gear G1 and a transmission gear G2 (see FIG. 4). The fixing belt 610 rotates following the pressure roller 62. The sheet P on which the toner image is formed passes through the nip portion N while being heated and pressed, whereby the toner image is fixed on the sheet P.

(2.1) Fixing Belt Module

As shown in FIG. 2, the fixing belt 610 is formed in an endless shape, receives a driving force from the rotating pressure roller 62, and rotationally performs driving (circularly moves) in a direction of an arrow A in FIG. 2. As shown in FIG. 3A, the fixing belt 610 includes, for example, a base layer 610*a* formed of polyimide resin, an elastic body layer 610*b* that is formed of silicone rubber and is laminated on a surface side (outer peripheral surface side) of the base layer 610*a*, and a peeling layer 610*c* that is formed of PFA (tetrafluoroethylene-perfluoroalkyl vinyl ether copolymer) or the like and is coated on the elastic body layer 610*b*.

The fixing belt module 61 is provided with a first tension roller 612 that is rotatably provided and stretches the fixing belt 610 from inside with tension. A second tension roller 613 that stretches the fixing belt 610 from the inside with tension is provided upstream of the first tension roller 612 in the moving direction of the fixing belt 610. A steering mechanism 614 that displaces (steers) the second tension roller 613 is provided inside the fixing belt 610.

When the second tension roller 613 is displaced by the steering mechanism 614, the fixing belt 610 moves in a width direction of the sheet P, and a position of the fixing belt 610 in the width direction of the sheet P is adjusted.

A pressing member 615 that receives a load from the pressure roller 62 is provided at a position where the pressing member 615 faces the pressure roller 62 across the fixing belt 610. As a result, the sheet P is sandwiched from both sides and pressure is applied to the sheet P by the pressure roller 62 and the pressing member 615. Heaters 616 are provided inside the first tension roller 612, the second tension roller 613, and the pressing member 615, respectively to heat them. The heater 616 is configured with, for example, a halogen heater.

(2.2) Pressure Roller

As shown in FIG. 3B, the pressure roller 62 is constituted by laminating, for example, a cylindrical core member 621 made of metal, a heat-resistant elastic body layer 622 (for example, a silicone rubber layer or a fluororubber layer) coated on an outer peripheral surface of the core member 621, and a release layer 623, if necessary, coated with heat-resistant resin such as PFA or with a heat-resistant rubber.

The pressure roller 62 is pressed against the pressing member 615 via the fixing belt 610 by a moving mechanism 100 (which will be described later) to form the nip portion N. The pressure roller 62 is supported by the moving mechanism 100 so as to be capable of contacting with and separating from the outer peripheral surface of the fixing belt 610. During fixing operation, the pressure roller 62 rotates in a direction of an arrow B in FIG. 2, and the sheet P that carries an unfixed toner image passes through the nip portion N, so that the unfixed toner image is fixed on the sheet P by applying heat and a pressure.

(2.3) Sheet Guide Unit

A first sheet guide member 618 that guides the sheet P transported to the nip portion N is provided upstream of the nip portion N in a transport direction of the sheet P.

A second sheet guide member 619 that guides the sheet P transported from the nip portion N to a downstream side of the sheet P is provided downstream of the nip portion N.

(2.3) Moving Mechanism of Fixing Device

Figure 5:
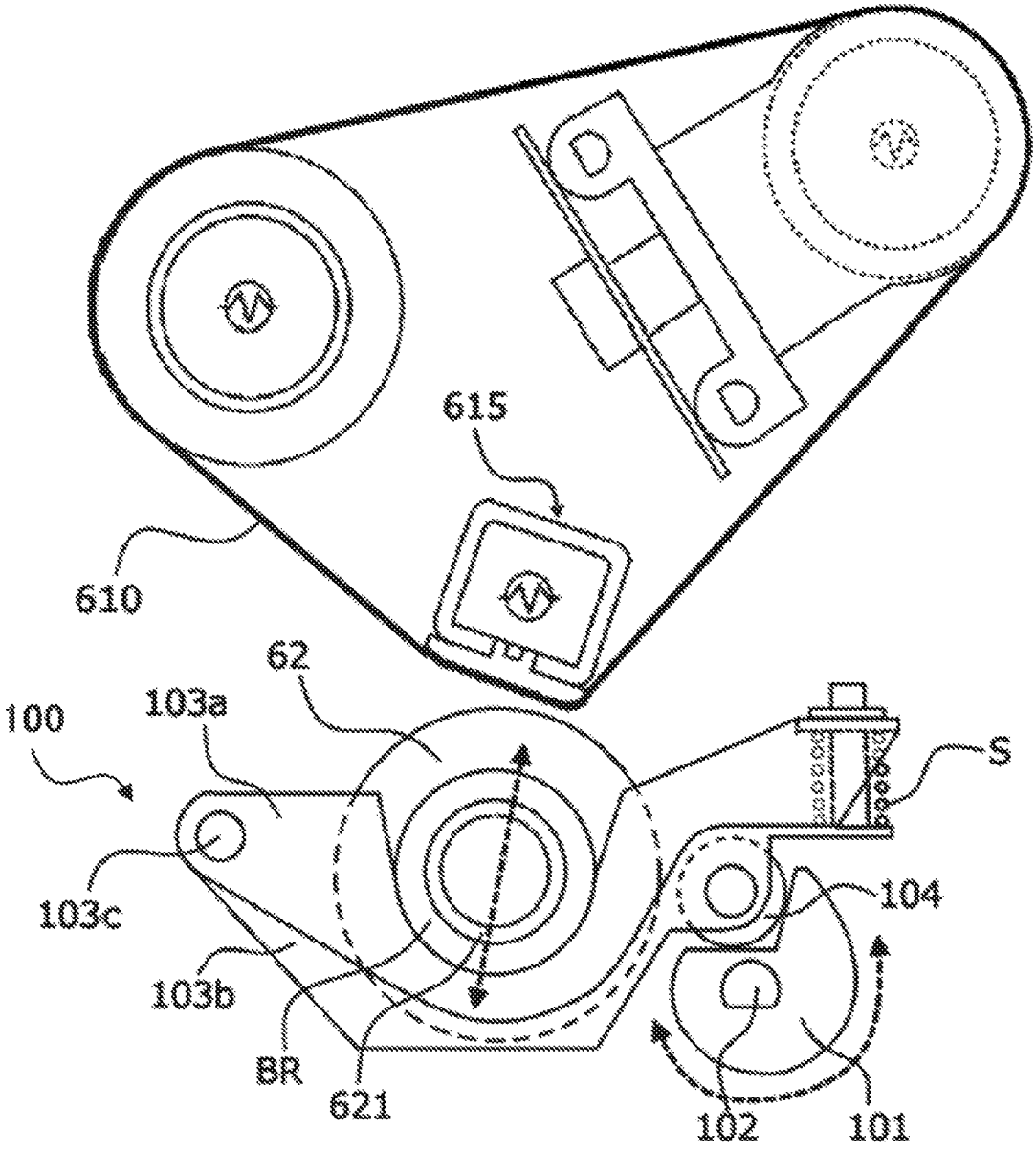
FIG. 5 is a view showing a moving mechanism in the fixing device.
Figure 6:
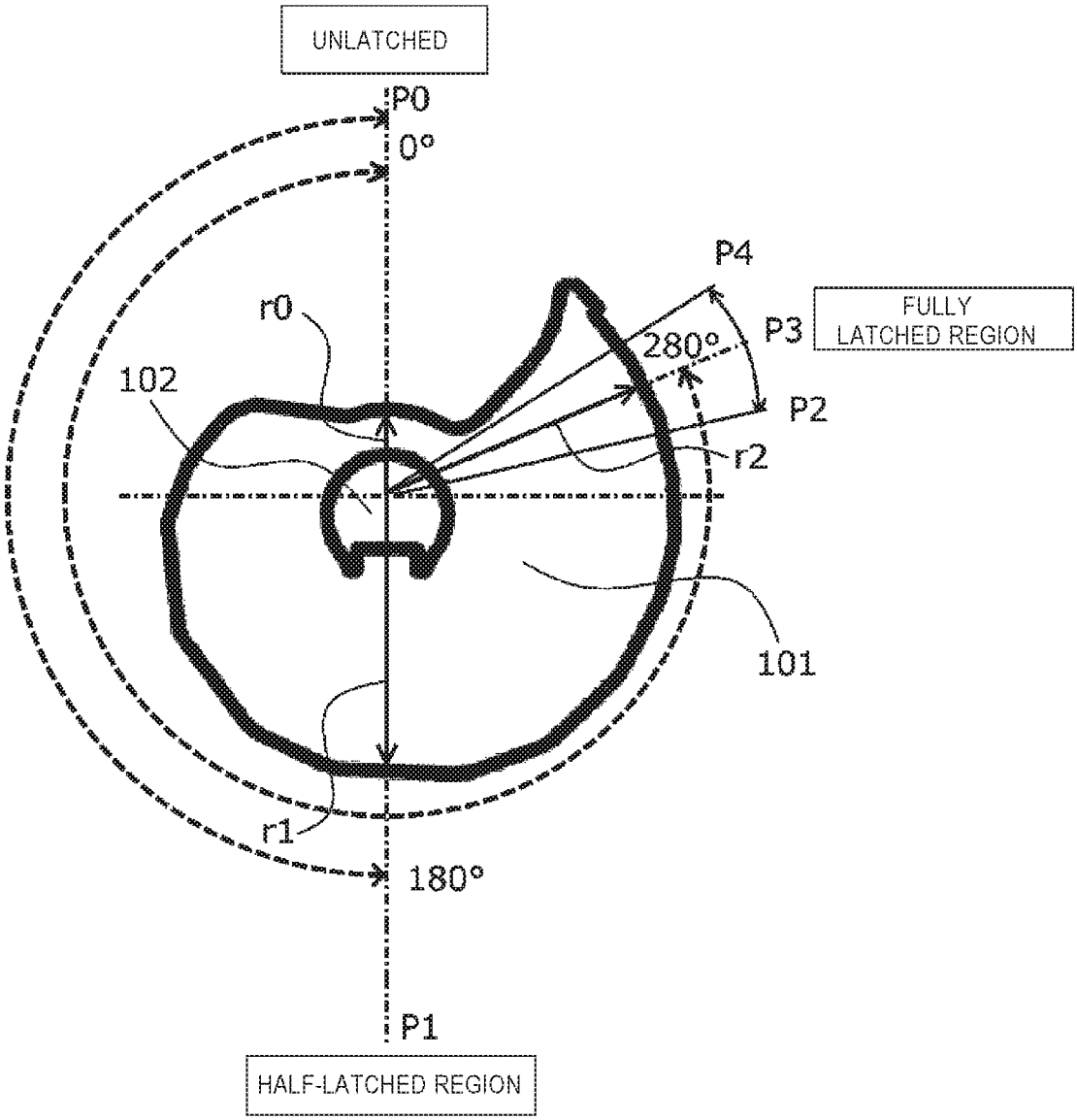
FIG. 6 is a schematic view showing a configuration of an eccentric cam.
Figure 7A:
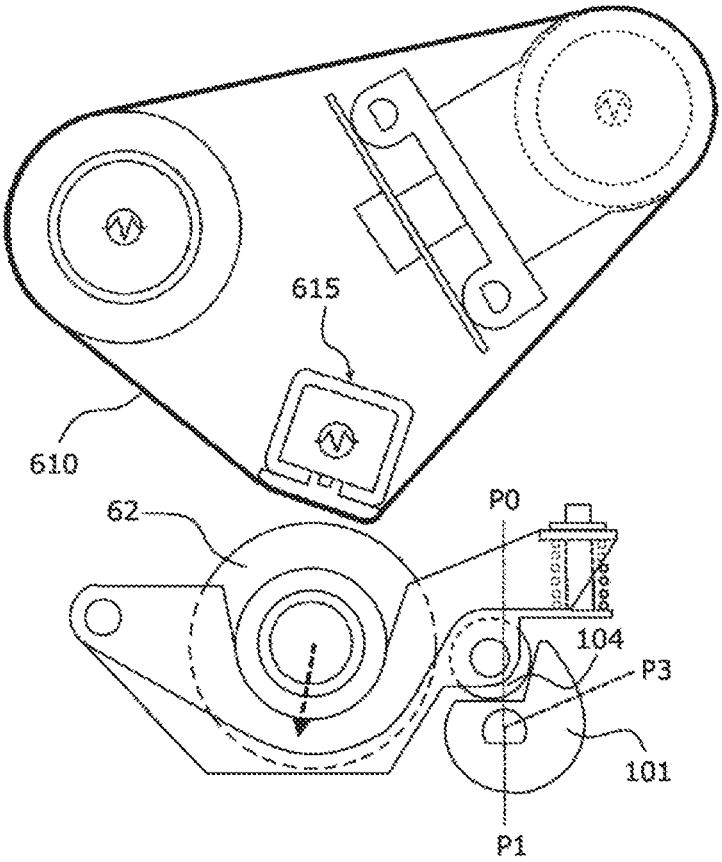
FIGS. 7A and 7B are views showing an unlatched state in which a nip is not formed.
Figure 7B:
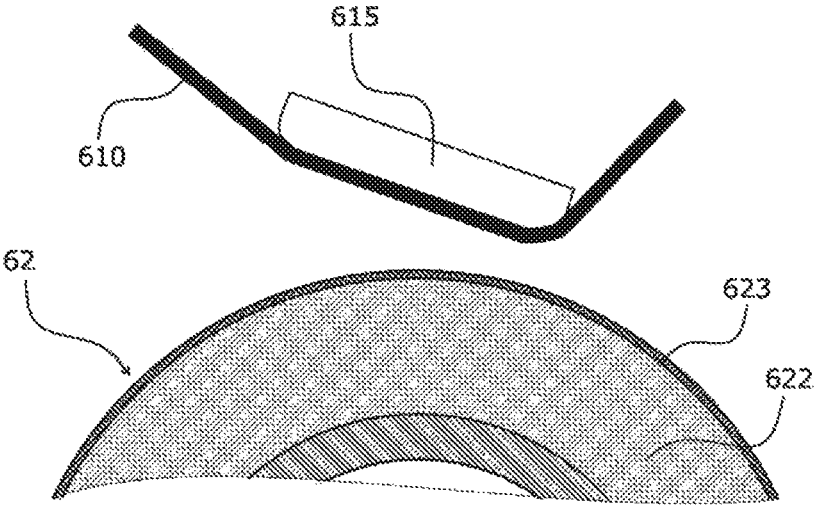
Figure 8A:
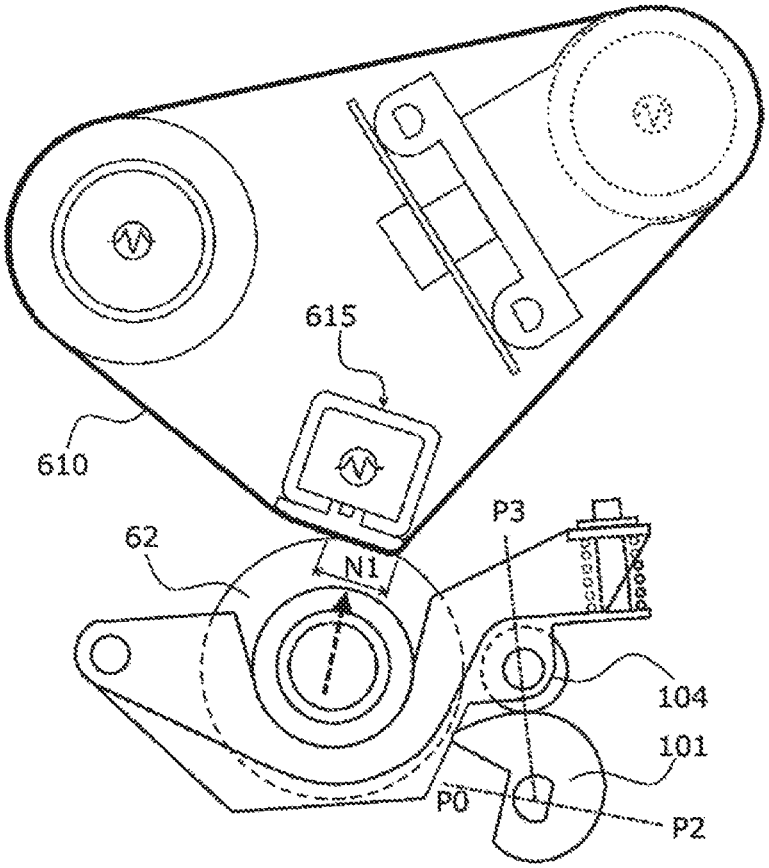
FIG. 8A is a view showing a fully latched state.
Figure 8B:
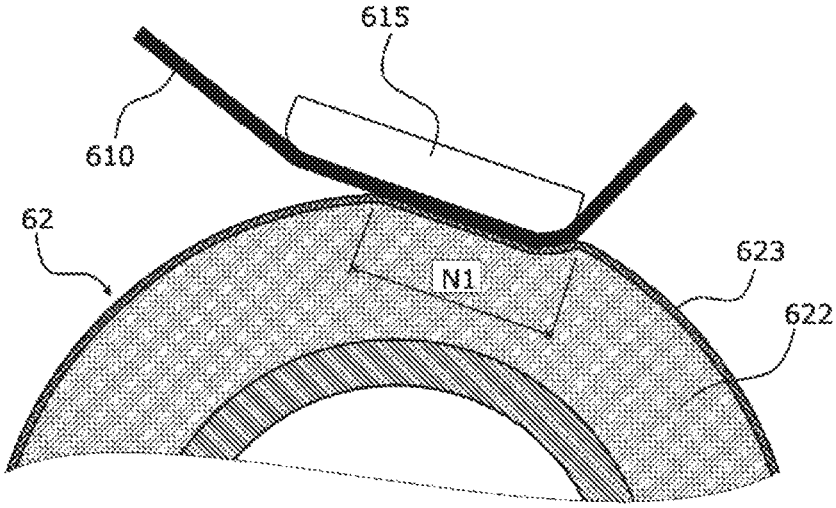
FIG. 8B is a view showing a contact state between the fixing belt and the pressure roller in the fully latched state.
Figure 9A:
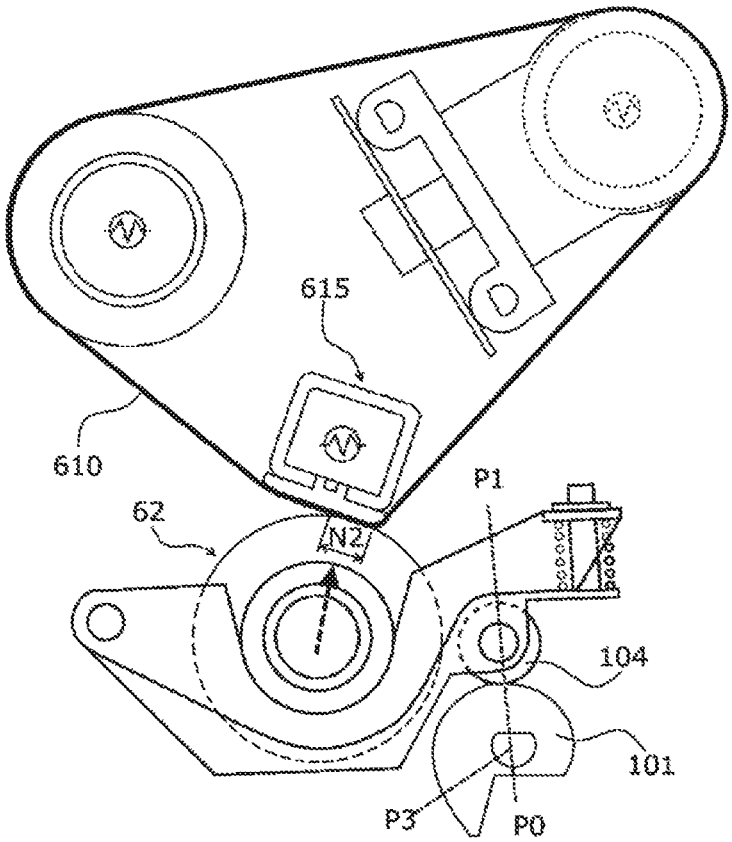
FIG. 9A is a view showing a half-latched state.
Figure 9B:
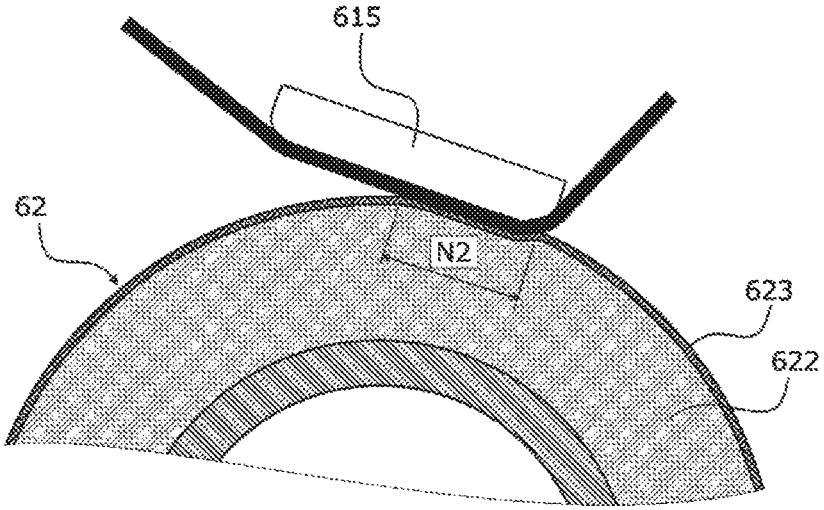
FIG. 9B is a view showing a contact state between the fixing belt and the pressure roller in the half-latched state.

FIG. 5 is a view showing the moving mechanism 100 in the fixing device 60. FIG. 6 is a schematic view showing a configuration of an eccentric cam 101. FIGS. 7A and 7B are views showing an unlatched state in which the nip is not formed. FIG. 8A is a view showing a fully latched state. FIG. 8B is a view showing a contact state between the fixing belt 610 and the pressure roller 62 in the fully latched state. FIG. 9A is a view showing a half-latched state. FIG. 9B is a view showing a contact state between the fixing belt 610 and the pressure roller 62 in the half-latched state.

As shown in FIGS. 4 and 5, the moving mechanism 100 includes the eccentric cams 101 that rotate around a shaft 102, movable arms 103, a latch motor M2 serving as a driving source, and transmission gears 105, 106. The movable arm 103 has a double structure including an outer movable arm 103*a* and an inner movable arm 103*b* (partially omitted in FIG. 5). The outer movable arm 103*a* and the inner movable arm 103*b* are coupled by a coupling pin (not shown) and rotate together around a rotation shaft 103*c*.

The outer movable arms 103*a* support the core member 621 of the pressure roller 62 via a bearing BR. Each inner movable arm 103*b* includes a cam follower 104 that faces the eccentric cam 101. A coil spring S is disposed between the outer movable arm 103*a* and the inner movable arm 103*b*. The coil springs S press the outer movable arms 103*a* toward the fixing belt 610.

When the pressure roller 62 is in a separation position (in the unlatched state) shown in FIG. 5, if the respective eccentric cams 101 are rotated around the shaft 102, the respective inner movable arms 103*b* are pushed up together with the respective cam followers 104. The inner movable arms 103*b* push up the outer movable arms 103*a* via the coil springs S. Accordingly, the pressure roller 62 supported by the outer movable arms 103*a* moves to a pressure position, and is brought into pressure contact with the fixing belt 610 (in the fully latched state: see FIGS. 8A and 8B).

FIG. 6 is a schematic view showing an example of the configuration of the eccentric cam 101. As shown in FIG. 6, the eccentric cam 101 is an elliptical flat plate having a partially cutout portion, and the shaft 102 is located away from a center point of the eccentric cam 101. The eccentric cam 101 includes a small diameter portion having a small distance (diameter) from the shaft 102 to a peripheral surface of the eccentric cam 101, and a large diameter portion having a large distance (diameter) from the shaft 102 to the peripheral surface of the eccentric cam 101.

At a point P0 on the peripheral surface, a radius of the eccentric cam 101 is a minimum diameter r0. A rotation angle of the eccentric cam 101 located at a position where the point P0 faces the cam follower 104 is 0° (zero). When the rotation angle of the eccentric cam 101 is zero, the pressure roller 62 is in the separation position (in the unlatched state: see FIGS. 7A and 7B), and a pressure-contact pressure is zero. Further, at a point P3 on the peripheral surface, the radius of the eccentric cam 101 is a maximum diameter r2. The rotation angle of the eccentric cam 101 located at a position where the point P3 faces the cam follower 104 is 280°. When the rotation angle of the eccentric cam 101 is 280°, the pressure roller 62 is in a pressure-contact position (in the fully latched state: see FIGS. 8A and 8B), the pressure-contact pressure is a predetermined value set in advance, and a nip width of the nip portion N is a first nip width N1 as shown in FIG. 8B. At this time, a position of the pressure roller 62 is a final pressing position.

In the present exemplary embodiment, the radius of the eccentric cam 101 is the maximum diameter r2 in a region from a point P2 through the point P3 to a point P4 on the peripheral surface. Since the radius of the eccentric cam 101 is constant in this region, the pressure-contact pressure is also constant.

When the rotation angle of the eccentric cam 101 located at a position where a point P1 faces the cam follower 104 is 180°, the radius of the eccentric cam 101 is an intermediate diameter r1 smaller than the maximum diameter r2, the pressure-contact pressure is smaller than that when the rotation angle of the eccentric cam 101 is 280°, and the nip width of the nip portion N is a second nip width N2 smaller than the first nip width N1 as shown in FIG. 9B (in the half-latched state: see FIGS. 9A and 9B).

In the present exemplary embodiment, the configuration has been described in which the moving mechanism 100 brings the pressing roller 62 serving as the pressure unit into pressure contact with the fixing belt 610 serving as the heating unit or causes the pressing roller 62 to be separated from the fixing belt 610. Alternatively, the moving mechanism 100 may move elements on a fixing belt 610 side to be in pressure contact with or separated from the pressure roller 62. In this case, by moving the pressing member 615, the fixing belt 610 is unlatched, fully latched, or half-latched with respect to the pressure roller 62.

(3) Operation and Function of Fixing Device (3.1) Operation of Fixing Device

Next, the operation of the fixing device 60 will be described according to the present exemplary embodiment.

First, for example, when toner image forming operation is started in the image forming apparatus 1, the fixing device 60 changes from a state where the fixing belt 610 and the pressure roller 62 are separated (the unlatched state) to a state where the fixing belt 610 and the pressure roller 62 are in pressure contact (the fully latched state), the pressure roller 62 is driven to rotate by the driving motor M1, and the fixing belt 610 is driven to rotate in accordance with the rotational driving of the pressure roller 62 (see the arrow A in FIG. 2).

While the fixing belt 610 is rotationally driven, an alternating current is supplied to the heater 616 to heat the fixing belt 610. Here, since the fixing belt 610 is a thin-walled member including the base layer 610*a* formed of polyimide resin, the elastic body layer 610*b* formed of silicone rubber, and the peeling layer 610*c* formed of PFA or the like, and has a small heat capacity, the fixing belt 610 is heated to a set temperature (for example, 150° C.) in a short warm-up time.

Next, in a state (the fully latched state) where the pressure roller 62 is pressed against the fixing belt 610, the sheet P fed into the fixing device 60 is guided by the first sheet guide member 618, fed into the nip portion N between the fixing belt 610 and the pressure roller 62, and heated and pressed by the fixing belt 610, which is heated by the heaters 616, and the pressure roller 62, thereby fixing the toner image on a surface of the sheet P.

When fed out from the nip portion N between the fixing belt 610 and the pressure roller 62, the sheet P is peeled off from the surface of the fixing belt 610, guided by the second sheet guide member 619, and transported to the sheet discharge unit 30.

(3.2) Function of Fixing Device

Here, as described above, since the pressure roller 62 is constituted by laminating the heat-resistant elastic body layer 622 and the release layer 623 coated with heat-resistant resin or with a heat-resistant rubber on the outer peripheral surface of the core member 621 (see FIG. 3B), the pressure roller 62 thermally expands by heating.

Therefore, when a rotation speed of the pressure roller 62 is constant, a linear velocity of the outer peripheral surface of the pressure roller 62 changes in accordance with a change in an outer diameter of the pressure roller 62. Since the fixing belt 610 is driven to rotate by the rotational driving of the pressure roller 62 in a state (the fully latched state) where the pressure roller 62 is in pressure contact with the fixing belt 610 as described above, a rotational speed of the fixing belt 610 also changes.

Therefore, rotation of the driving motor M1 is controlled in accordance with the rotation speed of the pressure roller 62. The rotation speed of the pressure roller 62 is determined based on rotation speed of the fixing belt 610 and a temperature of the fixing belt 610. As a result, the rotation of the driving motor M1 is maintained within a preset range in a normal job.

On the other hand, when rotation is continued without the sheet P passing through the nip portion N of the fixing device 60 (heated idle rotation), for example, in a setup cycle of the image forming apparatus 1 during a printing job, in image information conversion processing in the image processing unit, or in pre-processing or post-processing of the image forming operation, heat is directly transferred to the pressure roller 62 from the fixing belt 610, which is under a high temperature control and controlled to a predetermined temperature without being absorbed by the sheet P, and a temperature of the pressure roller 62 excessively rises as compared with a normal job.

Further, even in the normal job, when a distance between the preceding sheet P and the subsequent sheet P is long during the continuous printing, heat is directly transferred from the fixing belt 610 to the pressure roller 62 in a similar manner, and the temperature of pressure roller 62 excessively rises.

When the temperature of the pressure roller 62 excessively rises and the pressure roller 62 thermally expands, a nip profile (for example, a nip width in a sheet width direction, and a pressure) in the nip portion N changes. When the sheet P onto which the toner image is transferred in the transfer device 15 is fed into the nip portion N of the fixing device 60 in this state, a sheet wrinkle might occur on the sheet P, a trailing end of the sheet might bounce unevenly, or a part of the toner on the sheet P might be brought into contact with the surface of the fixing belt 610 before the sheet P enters the nip portion N which causes uneven fixing, and therefore an image quality might deteriorate.

(3.3) Operation Control of Fixing Device

Figure 10:
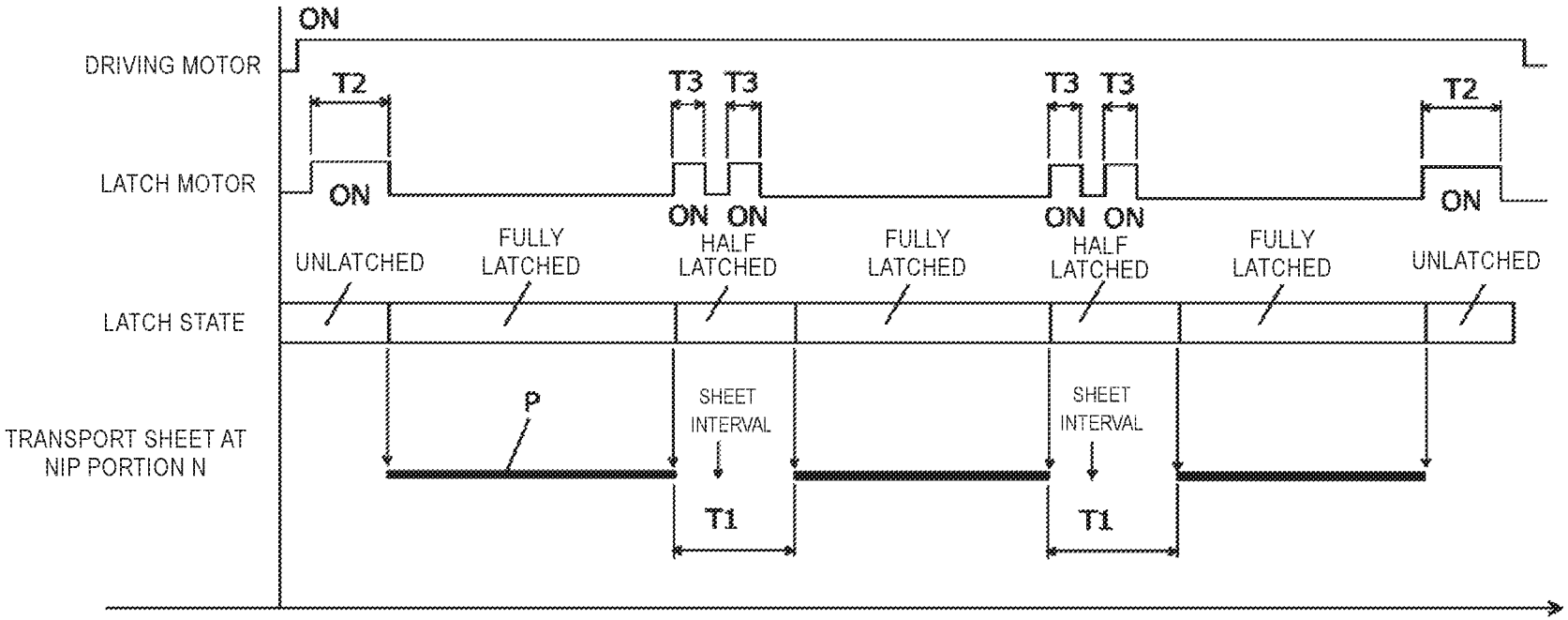
FIG. 10 is a diagram showing a relationship among operation of a driving motor, operation of a latch motor, and a latch state during continuous printing.

FIG. 10 is a diagram showing a relationship between operation of the driving motor M1, operation of the latch motor M2, and a latch state during continuous printing.

In the fixing device 60 according to the present exemplary embodiment, when plural sheets P are transported successively, the system control device 11 controls the moving mechanism 100 so that the pressure roller 62 moves in a separation direction to reduce a nip width at a sheet interval between a preceding sheet P and a subsequent sheet P.

FIG. 10 schematically shows the unlatched state, the fully latched state, and the half-latched state which are caused by the driving motor M1, the latch motor M2, and the moving mechanism 100 during the continuous printing, together with transportation of the sheets P.

When a continuous printing job is started, the system control device 11 controls the driving motor M1 and the latch motor M2. Specifically, the driving motor M1 is turned on, and the pressure roller 62 is driven to rotate. The latch motor M2 is turned on slightly after the driving motor M1 is turned on. The eccentric cams 101 of the moving mechanism 100 rotate for a predetermined time T2, so that a nip state of the nip portion N of the fixing device 60 becomes the fully latched state and has the first nip width N1.

In this state, the sheet P on which the toner image is formed by the image forming unit 10 is transported, and heated and pressed by the fixing belt 610, which is heated by the heaters 616, and the pressure roller 62 at the nip portion N, so that the toner image is fixed on the surface of the sheet P. In a case of the continuous printing, an interval time between the preceding sheet P and the subsequent sheet P is set to a sheet interval time T1 that allows the image forming apparatus 1 to print images with predetermined productivity (PPM).

At a timing when the preceding sheet P passes through the nip portion N, the latch motor M2 is turned on, the nip state of the nip portion N changes from the fully latched state to the half-latched state and has the second nip width N2. Specifically, the latch motor M2 is turned on for a sheet interval time T3 shorter than the sheet interval time T1, the eccentric cams 101 are rotated from the point P3 to the point P2, and the pressure roller 62 moves in the separation direction away from the fixing belt 610 and is brought in the half-latched state. Accordingly, the nip state becomes the second nip width N2 that is narrower than the first nip width N1 in the fully latched state, and an amount of heat received by the pressure roller 62 from the fixing belt 610 is reduced.

The latch motor M2 is turned on again for the time T3, the eccentric cams 101 are rotated in a reverse direction from the point P2 to the point P3, and the pressure roller 62 moves so as to be in pressure contact with the fixing belt 610 and is brought in the fully latched state. A total time (T3+T3) of the rotation time T3 of the eccentric cams 101 from the fully latched state to the half-latched state and the rotation time T3 of the eccentric cams 101 from the half-latched state to the fully latched state is shorter than the sheet interval time T1.

Accordingly, when the predetermined productivity (PPM) can be achieved using the sheet interval time T1 during the continuous printing, once the pressure roller 62 is half-latched at a sheet interval, in order to perform fixing on the subsequent sheet P, the pressure roller 62 returns to the fully latched state again. In this case, the amount of heat received by the pressure roller 62 at the sheet interval is reduced without sacrificing the productivity of the image forming apparatus 1, so that thermal expansion of the pressure roller 62 is prevented. As a result, a change in the nip profile in the sheet width direction of the nip portion N is prevented, and occurrence of an image defect such as a sheet wrinkle or uneven fixing at the trailing end of an image is prevented.

(Modification)

Figure 11:
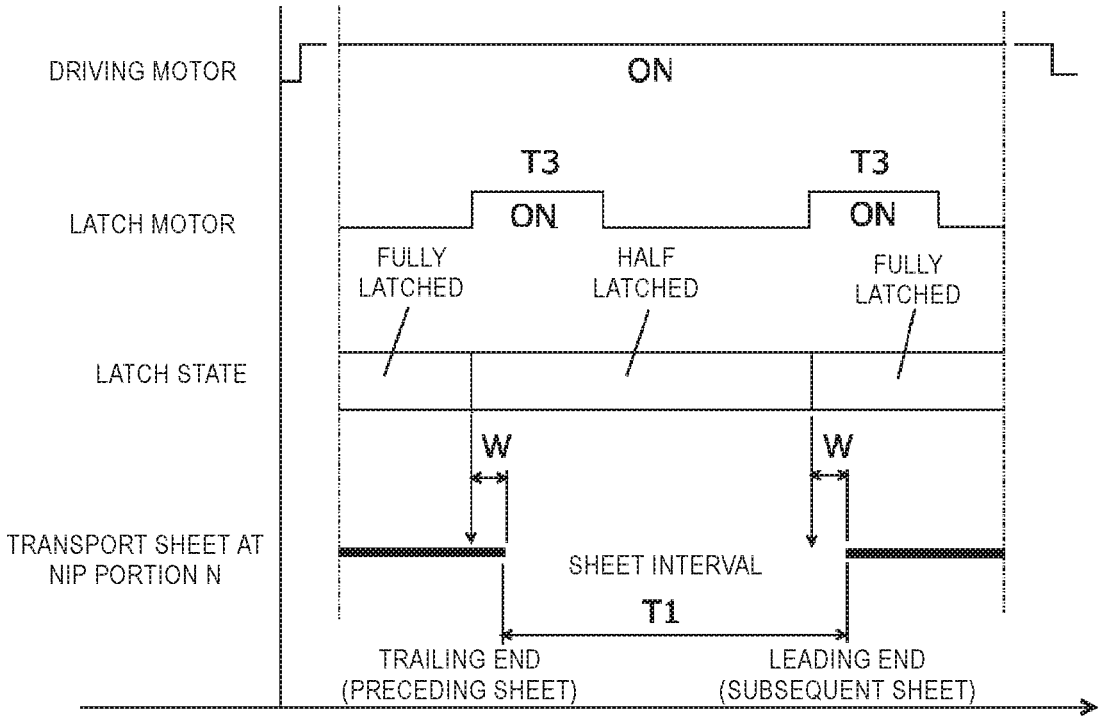
FIG. 11 is a diagram showing a relationship between operation of the latch motor and a latch state at a sheet interval during the continuous printing.

FIG. 11 is a diagram showing a relationship between operation of the latch motor M2 and a latch state at a sheet interval during continuous printing.

In operation control of the fixing device 60 according to the present exemplary embodiment, before the trailing end of the preceding sheet P passes through the nip portion N during the continuous printing, the latch motor M2 is turned on, the eccentric cams 101 are rotated from the point P3 to the point P2, and the pressure roller 62 in the fully latched state may be controlled to move in the separation direction and to be brought in the half-latched state so as to have the second nip width N2. Specifically, when a margin region W (usually 2 mm to 4 mm) at the trailing end of the sheet P is located at the nip portion N, the fully latched state is changed to the half-latched state, so that an amount of heat received by the pressure roller 62 at a sheet interval is further reduced.

Before a leading end of the subsequent sheet P enters the nip portion N (a distance equivalent to that of a leading end margin region) during the continuous printing, the latch motor M2 is turned on, the eccentric cams 101 are rotated from the point P2 to the point P3, and the pressure roller 62 in the half-latched state may be controlled to move in the pressure direction and to be brought in the fully latched state so as to have the first nip width N1. Accordingly, while the amount of heat received by the pressure roller 62 in the half-latched state at the sheet interval is reduced, the subsequent sheet P is reliably heated and pressed in the fully latched state from the leading end thereof.

As described above, in the fixing device 60 according to the present exemplary embodiment, when the sheets P are transported successively during the continuous printing, a nip state at a sheet interval between the preceding sheet P and the subsequent sheet P is brought in the half-latched state. As a result, thermal expansion of the pressure roller 62 is prevented while the amount of heat received by the pressure roller 62 at the sheet interval is reduced, thereby preventing an image defect caused by a fluctuation in a nip pressure in a direction intersecting the sheet transport direction due to a change in the profile of the pressure roller 62.

The present exemplary embodiment describes that the fixing device 60 in which the fixing belt 610 supported in a stretched state with tension by the tension rollers each including a halogen heater is heated and brought into pressure contact with the pressure roller 62 formed of the silicone rubber layer. It should be noted that the fixing device is not limited thereto. A fixing device including a fixing belt that includes a heating unit of electromagnetic induction and a pressure roller may be also applied.

The foregoing description of the exemplary embodiments of the present disclosure has been provided for the purposes of illustration and description. It is not intended to be exhaustive or to limit the present disclosure to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating unit configured to heat a toner on a recording medium;

a pressure unit configured to transport the recording medium while sandwiching the recording medium in a nip that the pressure unit and the heating unit form;

a moving unit configured to change a nip state of the pressure unit with respect to the heating unit by moving the heating unit or the pressure unit; and a controller configured to, when plural recording media are transported continuously, control the moving unit so that the moving unit moves the heating unit or the pressure unit in a separation direction so as to reduce a nip width at a recording medium interval between the recording media, wherein the moving unit changes the nip width to a second nip width by moving the heating unit or the pressure unit in the separation direction, the second nip width is narrower than a first nip width when the pressure unit is pressed against the heating unit and reaches a final pressing position, and wherein the controller controls the moving unit so that the nip state becomes the first nip width by the moving unit moving the heating unit or the pressure unit in a pressure direction before a leading end of the recording medium enters the nip.

2. The fixing device according to claim 1, wherein the moving unit comprises an eccentric cam, the moving unit moves the pressure unit in a pressure direction and in the separation direction away from the heating unit by rotation of the eccentric cam, and the controller controls the moving unit to stop the rotation of the eccentric cam when the nip width becomes the second nip width.

3. An image forming apparatus comprising:

an image forming unit configured to form an image on a recording medium; and the fixing device according to claim 1.

4. The fixing device according to claim 2, wherein the controller controls the moving unit so that the nip state becomes the first nip width by the moving unit moving the heating unit or the pressure unit in the pressure direction before a leading end of the recording medium enters the nip.

5. An image forming apparatus comprising:

an image forming unit configured to form an image on a recording medium; and the fixing device according to claim 2.

6. The fixing device according to claim 4, wherein the controller controls the moving unit so that the nip state becomes the second nip width by the moving unit starting to move the heating unit or the pressure unit in the separation direction before a trailing end of the recording medium is discharged from the nip.

7. An image forming apparatus comprising:

an image forming unit configured to form an image on a recording medium; and the fixing device according to claim 4.

8. An image forming apparatus comprising:

an image forming unit configured to form an image on a recording medium; and the fixing device according to claim 6.

9. A fixing device comprising:

a heating unit configured to heat a toner on a recording medium;

a pressure unit configured to transport the recording medium while sandwiching the recording medium in a nip that the pressure unit and the heating unit form;

a moving unit configured to change a nip state of the pressure unit with respect to the heating unit by moving the heating unit or the pressure unit; and a controller configured to, when plural recording media are transported continuously, control the moving unit so that the moving unit moves the heating unit or the pressure unit in a separation direction so as to reduce a nip width at a recording medium interval between the recording media, wherein the moving unit changes the nip width to a second nip width by moving the heating unit or the pressure unit in the separation direction, the second nip width is narrower than a first nip width when the pressure unit is pressed against the heating unit and reaches a final pressing position, and the controller controls the moving unit so that the nip state becomes the second nip width by the moving unit starting to move the heating unit or the pressure unit in the separation direction before a trailing end of the recording medium is discharged from the nip.

10. An image forming apparatus comprising:

an image forming unit configured to form an image on a recording medium; and the fixing device according to claim 9.

11. A fixing device comprising:

heating means for heating a toner on a recording medium;

pressure means for transporting the recording medium while sandwiching the recording medium in a nip that the pressure means and the heating means form;

moving means for changing a nip state of the pressure means with respect to the heating means by moving the heating means or the pressure means; and means for, when plural recording media are transported continuously, controlling the moving means so that the heating means or the pressure means in a separation direction so as to reduce a nip width at a recording medium interval between the recording media, wherein the moving means changes the nip width to a second nip width by moving the heating unit or the pressure means the separation direction, the second nip width is narrower than a first nip width when the pressure means is pressed against the heating means and reaches a final pressing position, and wherein the means for controlling controls the moving unit so that the nip state becomes the first nip width by the moving means moving the heating means or the pressure means in a pressure direction before a leading end of the recording medium enters the nip.

* * * * *